US007204175B2

(12) United States Patent
Hsieh

(10) Patent No.: US 7,204,175 B2
(45) Date of Patent: Apr. 17, 2007

(54) HAND TOOL WITH REPLACEABLE AND ROTATABLE FUNCTION HEAD

(76) Inventor: Chih-Ching Hsieh, No. 367, Pei Yang Rd., Fen Yuan, Taichung (TW)

( * ) Notice: Subject to any disclaimer, the term of this patent is extended or adjusted under 35 U.S.C. 154(b) by 0 days.

(21) Appl. No.: 11/228,404

(22) Filed: Sep. 19, 2005

(65) Prior Publication Data

US 2007/0062341 A1 Mar. 22, 2007

(51) Int. Cl.
*B25B 23/16* (2006.01)
*B25B 13/02* (2006.01)

(52) U.S. Cl. ..... 81/177.2; 81/423

(58) Field of Classification Search ..... 81/177.2, 81/177.7, 177.8, 177.85, 180.1, 423
See application file for complete search history.

(56) References Cited

U.S. PATENT DOCUMENTS 1,456,290 A * 5/1923 Tell ..... 81/165
2,680,985 A * 6/1954 Fish ..... 81/177.7
2,832,246 A * 4/1958 Livermont ..... 81/177.85
5,884,540 A * 3/1999 Mo ..... 81/423
6,186,033 B1 * 2/2001 Faro, Sr. ..... 81/177.7
D442,041 S * 5/2001 Chen ..... D8/28
6,408,723 B1 * 6/2002 Zurbuchen ..... 81/119
6,732,617 B2 * 5/2004 Steinweg et al. ..... 81/423
6,883,402 B2 * 4/2005 Cerda ..... 81/60
6,971,292 B2 * 12/2005 Hu ..... 81/177.8
2003/0217622 A1 * 11/2003 Steinweg et al. ..... 81/423
2004/0060398 A1 * 4/2004 Hsien ..... 81/177.7

* cited by examiner

*Primary Examiner*—David B. Thomas

(57) ABSTRACT

A hand tool includes a handle having a connection end which includes a receiving recess defined axially therein. A function head has an insertion which is removably inserted into the receiving recess and rotatable about a longitudinal axis of the connection end. A positioning device is located between the insertion and an inner periphery of the receiving recess to prevent the function head from dropping from the receiving recess axially. The function heads can be easily replaceable as needed.

3 Claims, 7 Drawing Sheets

HAND TOOL WITH REPLACEABLE AND ROTATABLE FUNCTION HEAD

FIELD OF THE INVENTION

The present invention relates to a hand tool having a rotatable and replaceable function head so as to easily access object at desired angles.

BACKGROUND OF THE INVENTION

Some conventional hand tools 90 known to applicant are shown in FIGS. 12 to 14 and generally include a handle 92 with a function head 91 pivotably connected to the handle 92, wherein the function head 91 can be a wrench as shown in FIG. 12, a ratchet driving head as shown in FIG. 13 or a ratchet box end as shown in FIG. 14. Although the function heads 91 can be pivoted about an axis perpendicular to the longitudinal axis of the handle 91, they cannot be replaceable and has a fixed function so that the user has to carry different types of the hand tools 90 and choose one of them according to the object to be tightened or loosened. In addition, the size of each of the function heads 92 is fixed so that the users have to prepare different sizes of the same type of function head.

The present invention intends to provide a hand tool which includes a replaceable and rotatable function head such that the users can conveniently replace desired function head on the same handle.

SUMMARY OF THE INVENTION

The present invention relates to a hand tool that comprises a handle with a connection end which has a receiving recess defined axially therein so as to receive an insertion of a function head. A positioning device is located between the insertion and an inner periphery of the receiving recess to prevent the function head from dropping from the receiving recess axially.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
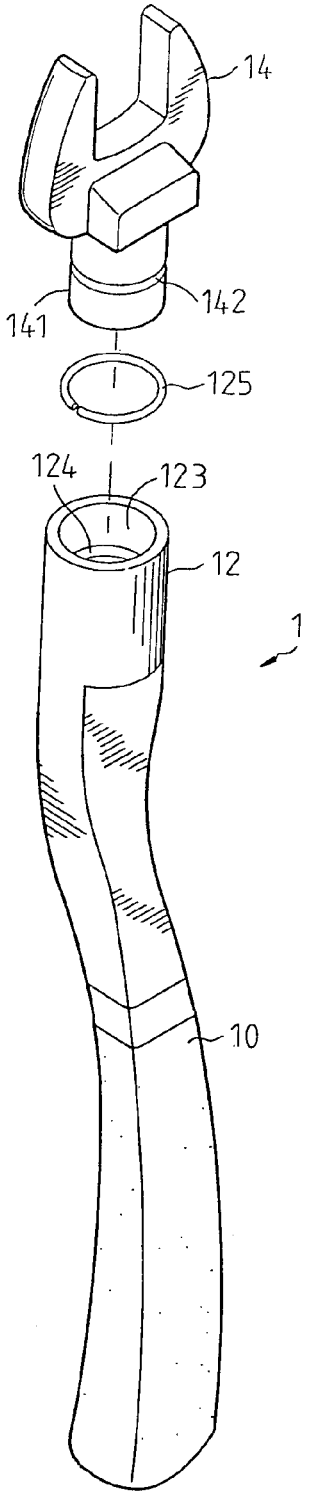
FIG. 1 is an exploded view to show function head and the handle with the connection end of the hand tool of the present invention.
Figure 2:
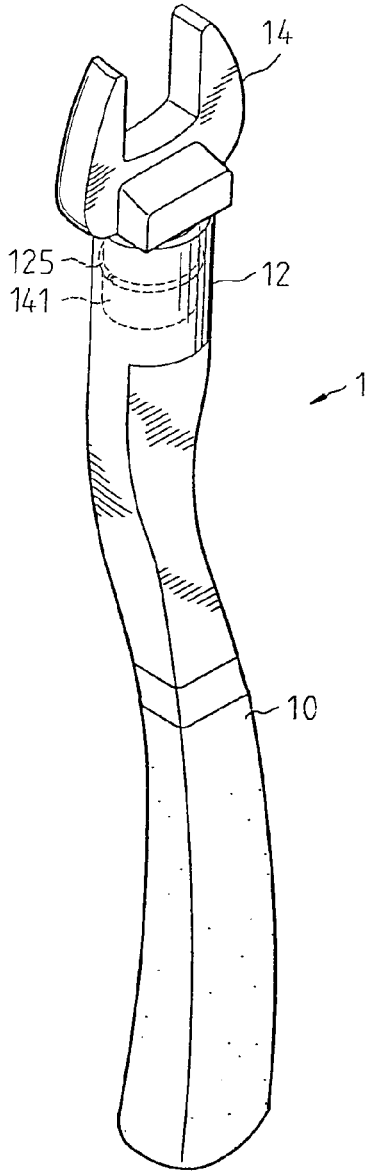
FIG. 2 is a perspective view to show the function head in FIG. 1 is connected to the connection end of the hand tool of the present invention.

Referring to FIGS. 1, 2, 6 and 7, the hand tool 1 of the present invention comprises a handle 10 having a connection end 12 connected to one of two ends thereof and the connection end 12 includes a receiving recess 123 defined axially therein. A function head 14 has an insertion 141 which is a cylindrical portion with circular cross section and removably inserted into the receiving recess 123 and rotatable about a longitudinal axis of the connection end 12. A positioning device is located between the insertion 141 and an inner periphery of the receiving recess 123 to prevent the function head 14 from dropping from the receiving recess 123 axially. The function head 14 is then co-rotated with rotation of the handle 10 to output a torque.

Figure 6:
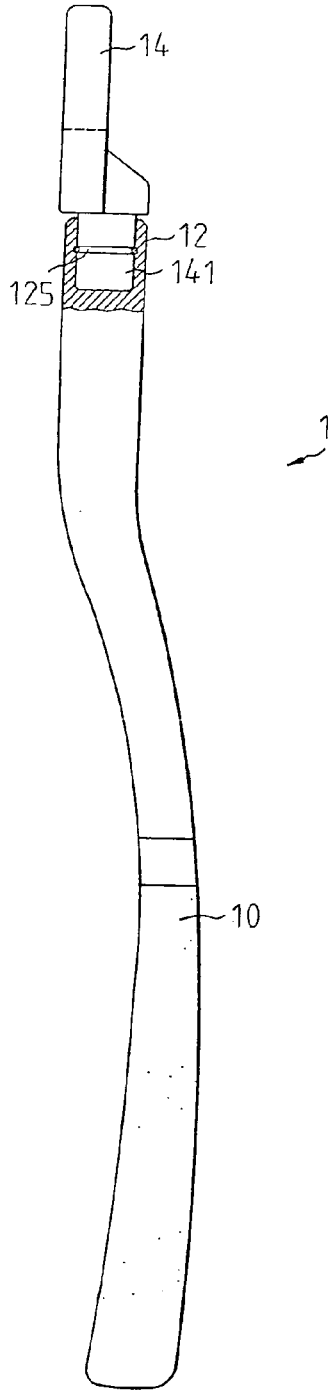
FIGS. 6 and 7 show that the function head can be rotated about a longitudinal axis of the connection end of the handle.
Figure 7:
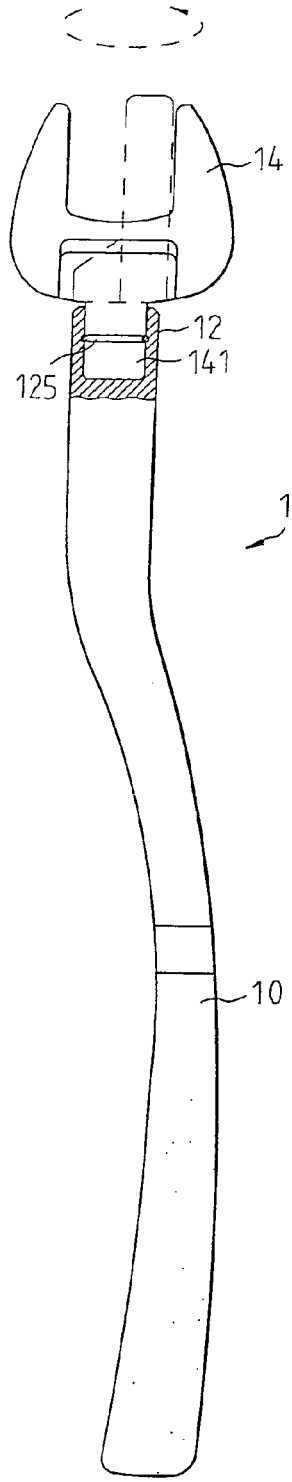

The positioning device includes a first groove 124 defined in the inner periphery of the receiving recess 124 and a second groove 142 defined in an outer periphery of the insertion 141. A clamp member 125 is engaged with the second groove 142. The user simply inserts the insertion 141 into the receiving recess 123 in the connection end 12 to let the clamp member 125 be engaged with the first groove 124 so as to position the insertion 141 in the receiving recess 124. It is noted that the function head 14 is rotatable about the longitudinal axis of the connection end 12 as shown in FIGS. 6 and 7 so that the user can easily and conveniently access the object to be tightened or loosened at desired angles.

Figure 3:
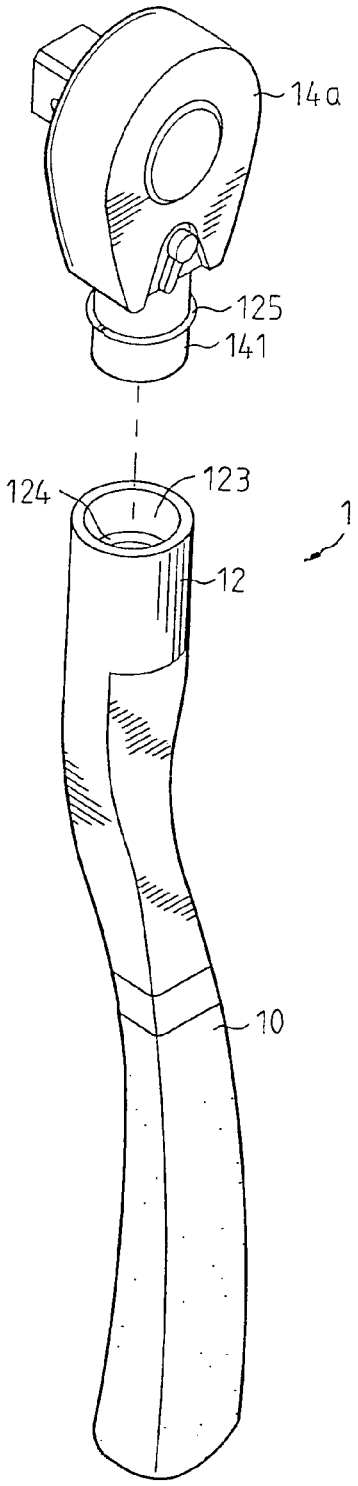
FIG. 3 to 5 show the hand tool with different function heads.
Figure 4:
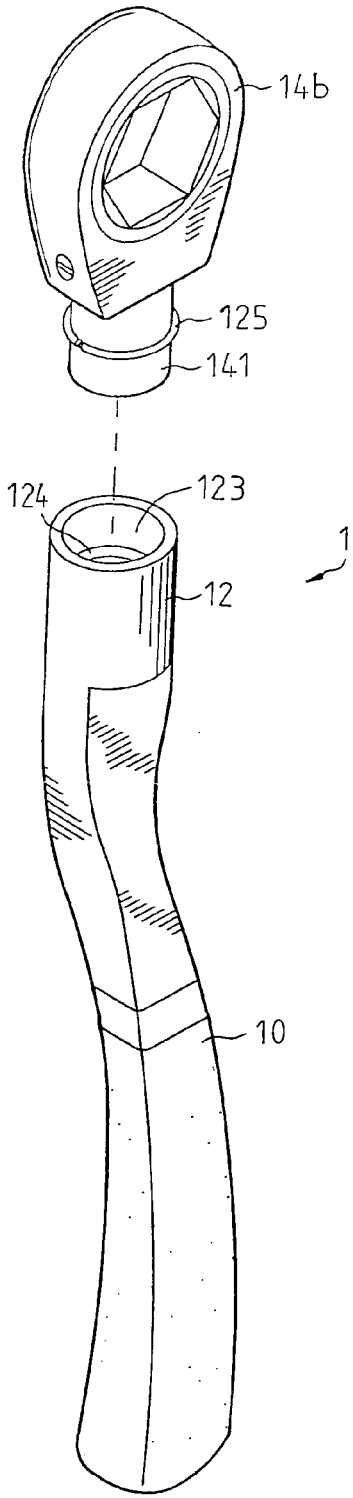
Figure 5:
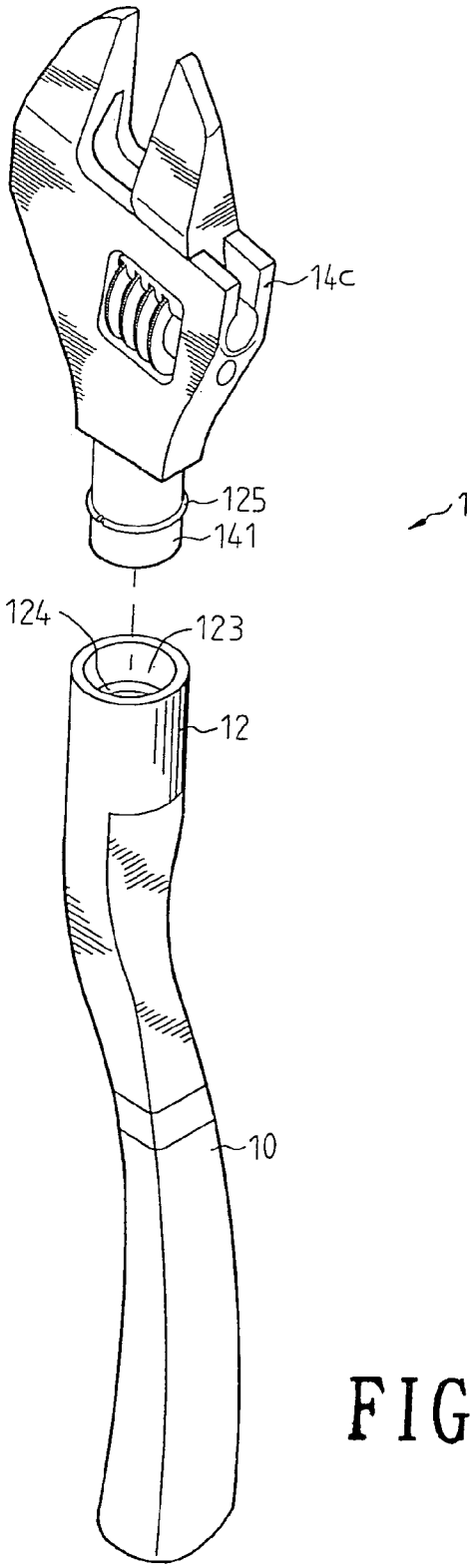

FIGS. 3 to 5 show that the function head can be a ratchet driving head 14*a*, a ratchet box end 14*b* or an adjustable wrench 14*c*.

Figure 8:
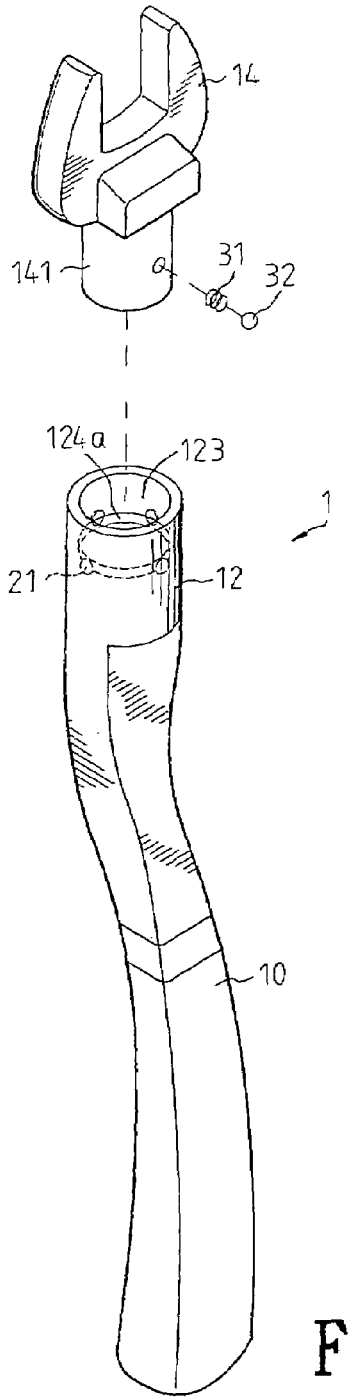
FIG. 8 is another embodiment of another embodiment of the positioning device for positioning the function head to the handle of the hand tool of the present invention.
Figure 9:
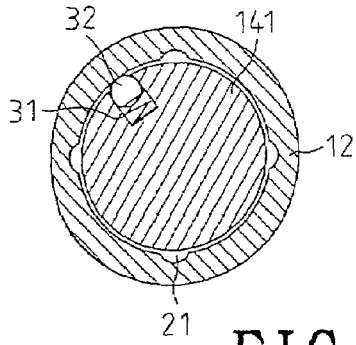
FIGS. 9 and 10 show that the bead is engaged with two different notches of the positioning device in FIG. 8.
Figure 10:
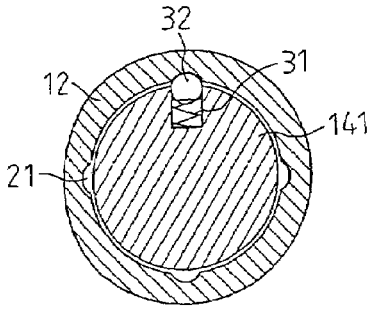

FIGS. 8–10 show another embodiment of the positioning device, wherein the positioning device includes a first groove 124*a* and a plurality of notches 21 are defined in the inner periphery of the receiving recess 124. The first groove 124*a* communicates with the notches 21. A hole is defined in an outer periphery of the insertion 141 and a spring 31 and a bead 32 are received in the hole. The bead 32 is biased by the spring 31 and partially protrudes out from the hole. The bead 32 is movably engaged with the first groove 124*a* and engaged with one of the notches 21. Therefore, the function head 14 can be positioned at four angular positions where the notches 21 are defined. The number of the notches 21 can be made more or less than four.

Figure 11:
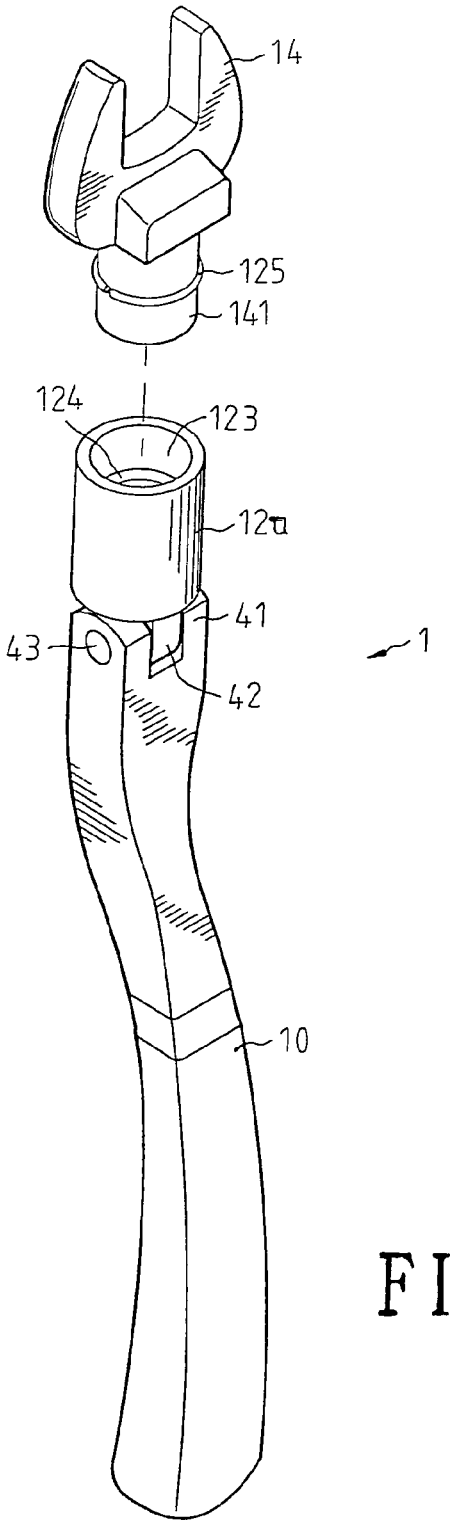
FIG. 11 shows that the connection end is pivotably connected to the handle.
Figure 12:
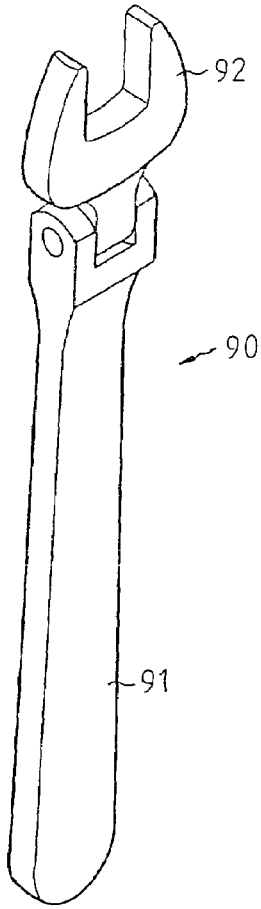
FIG. 12 PRIOR ART
FIGS. 12 to 14 show three different conventional hand tools.
Figure 13:
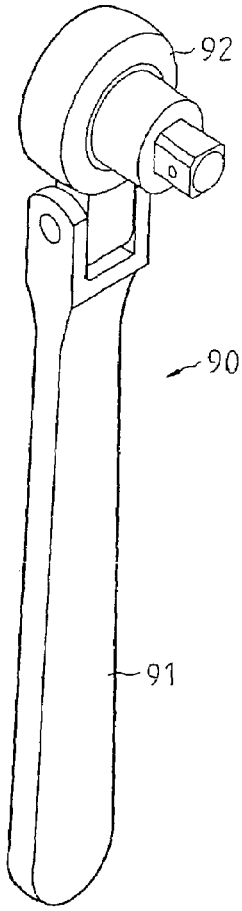
FIG. 13 PRIOR ART
Figure 14:
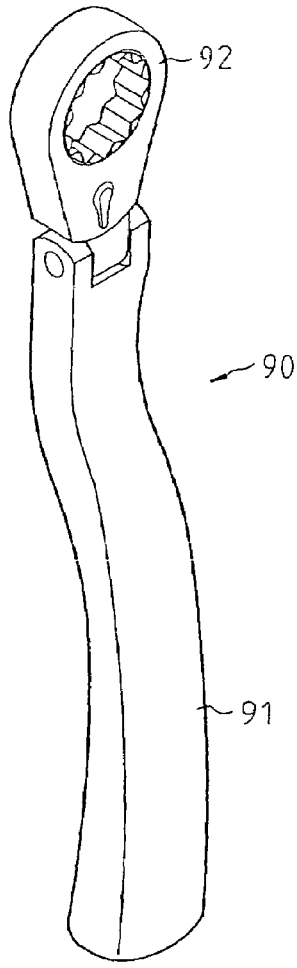
FIG. 14 PRIOR ART

FIG. 11 show another embodiment of the hand tool 1 wherein the handle 10 includes two lugs 41 extending from an end thereof and the connection end 12*a* includes a protrusion 42 which is pivotably connected between the two lugs 41 by a pin 43. Therefore, the connection end 12*a* and the function head 14 can be pivoted about the pin 43 when needed.

While we have shown and described the embodiment in accordance with the present invention, it should be clear to those skilled in the art that further embodiments may be made without departing from the scope of the present invention.

What is claimed is:

1. A hand tool comprising:

a handle having a connection end connected thereto, the connection end including a receiving recess defined axially therein, a function head having an insertion which is a cylindrical portion with circular cross section and removably inserted into the receiving recess and rotatable about a longitudinal axis of the connection end, and a positioning device located between the insertion and an inner periphery of the receiving recess to prevent the function head from dropping from the receiving recess axially, the positioning device including a first groove defined in the inner periphery of the receiving recess and a second groove defined in an outer periphery of the insertion, a clamp member engaged with the first and second grooves.

2. The hand tool as claimed in claim 1, the handle includes two lugs extending from an end thereof and the connection end includes a protrusion which is pivotably connected between the two lugs by a pin.

3. A hand tool comprising:

a handle having a connection end connected thereto, the connection end including a receiving recess defined axially therein, a function head having an insertion which is a cylindrical portion with circular cross section and removably inserted into the receiving recess and rotatable about a longitudinal axis of the connection end, and a positioning device located between the insertion and an inner periphery of the receiving recess to prevent the function head from dropping from the receiving recess axially, the positioning device including a groove and a plurality of notches defined in the inner periphery of the receiving recess, the groove communicating with the notches, a hole defined in an outer periphery of the insertion and a spring and a bead are received in the hole, the bead being biased by the spring and partially protruding out from the hole, and bead movably engaged with the groove and one of the notches.

* * * * *